US005727927A

United States Patent [19]

Luxenburger

[11] Patent Number: 5,727,927

[45] Date of Patent: Mar. 17, 1998

[54] DEVICE FOR SECURING ROTOR BLADES TO A ROTOR, ESPECIALLY OF A GAS TURBINE PROPULSION PLANT

[75] Inventor: Gerd Luxenburger, Olching, Germany

[73] Assignee: MTU Motoren- und Turbinen-Union Muenchen GmbH, Munich, Germany

[21] Appl. No.: 642,476

[22] Filed: May 3, 1996

[30] Foreign Application Priority Data

May 6, 1995 [DE] Germany ..... 195 16 694.9

[51] Int. Cl.[6] ..... F01D 5/18

[52] U.S. Cl. ..... 416/220 R; 416/221

[58] Field of Search ..... 416/220 R, 221, 416/219 R

[56] References Cited

U.S. PATENT DOCUMENTS

| | | | |
|---|---|---|---|
| 2,753,149 | 7/1956 | Kurti | 416/220 R |
| 2,971,744 | 2/1961 | Szydlowski | 416/221 |
| 2,980,395 | 4/1961 | Rubbra et al. | 416/221 |
| 3,395,891 | 8/1968 | Burge et al. | 416/220 R |
| 3,666,376 | 5/1972 | Damlis | 416/219 R |
| 4,191,509 | 3/1980 | Leonardi | 416/219 R |
| 4,505,640 | 3/1985 | Hsing et al. | 416/220 R |

FOREIGN PATENT DOCUMENTS

| | | |
|---|---|---|
| 950557 | 7/1955 | Germany . |
| 1033676 | 7/1958 | Germany . |
| 2853856 | 7/1979 | Germany . |
| 3008889 | 9/1980 | Germany . |
| 850979 | 10/1960 | United Kingdom . |
| 1213408 | 11/1970 | United Kingdom . |

*Primary Examiner*—John T. Kwon
*Attorney, Agent, or Firm*—W. G. Fasse; W. F. Fasse

[57] ABSTRACT

The blades of a turbine rotor are secured to a rotor disk by inserting the blade foot with its serrations into a respective serrated groove in the rim of the rotor disk, whereby serrations of blade foot side surfaces mesh with corresponding serrations in the side walls of the grooves in the rotor rim to interlock the blade foot with the rotor disk in the radial direction. The axial locking of the blade foot in the groove is accomplished by a rivet connection having a rivet shaft positioned in a gap between the radially inwardly facing sole of the blade foot and the radially outwardly facing bottom of the groove. The rivet heads rest against washers or washer rings. If flat head rivets are used, these heads are received in countersunk recesses in the washers or washer rings that bear partially against the side surface of the rotor disk rim and partially against an axial end surface of the respective blade foot. A radial biasing of the rivet shaft intermediate the shaft ends may be employed to minimize or eliminate radial play between the intermeshing serrated foot and groove surfaces.

31 Claims, 4 Drawing Sheets

DEVICE FOR SECURING ROTOR BLADES TO A ROTOR, ESPECIALLY OF A GAS TURBINE PROPULSION PLANT

FIELD OF THE INVENTION

The invention relates to securing rotor blades to a rotor disk by rivets. The rotor blades have blade roots or blade feet formed as serrated tongues held in respectively serrated grooves in a circumferential rim of a respective rotor disk.

BACKGROUND INFORMATION

Rivet connections for securing rotor blades to the rim of a rotor disk especially for holding the blade foot in the axial direction, have been investigated. In such connections the rivet shaft is received and guided axially in a space between the radially inner end of the blade foot and the groove bottom. This space will be referred to herein as groove gap or simply gap. In such rivet connections countersunk recesses are formed, for example, by milling in the side faces of the rotor disk. These countersinks receive the original rivet head also referred to as swaged head. The other rivet head formed by the riveting operation is referred to as locking head. One or the other rivet head may be positioned in the respective recess in the front face or back face of the rotor disk or vice versa. These countersinks are formed partly in the axially facing end surfaces of the respective blade foot and partly in the side surface of the rotor rim. Each individual rivet connection requires two countersinks, one in each side of the respective rotor disk. The formation of the countersink recesses, for example by a milling operation, makes the manufacturing process more cost intensive. Moreover, the countersinks must be formed with high precision because even the smallest deviations of the position of the countersinks relative to required positions and dimensions lead to an increased manufacturing risk, because rotor disk rejects may be produced and these disks are already expensive to begin with.

Maintenance work on rivet connections with countersinks directly in the disk sides and in the ends of the blade feet are also not facilitated by these countersinks because in case a blade must be replaced, the rivet can be removed only axially out of the gap if either the swaged head or the riveted locking head is first removed by a drilling operation. The drilling operation poses the relatively large danger that the material removal either on the blade foot or on the rotor rim or on both can severely damage the rim and/or the blade foot. Even the groove that receives the blade foot can be damaged. In extreme instances such damage may lead to the complete loss of the rotor disk.

Another disadvantage of the investigated rivet connections is seen in that it is not possible to realize an exact bearing surface for the respective rivet head with the countersinks provided directly in the rim and foot end face. This is due to the manufacturing tolerances that must be permitted for the respective connections between blade and disk and for the countersinks. Further, each countersink is formed substantially of two half sections, namely one in the blade foot end face and one in the disk rim, whereby providing an exact rivet head bearing surface is made even more difficult. As a result, the respective interlocking form fit of the rivet heads in the respective bearing surface provided by the countersink, imposes undesired blade positions and even blade distortions of the blade feet in the axial grooves, which must be avoided. Due to these undesired blade foot positions and distortions it is not possible to assure a uniform load distribution over the entire surface areas of the respective foot and groove meshing connection.

Further, the blades of the investigated disks are not uniformly loadable. These characteristics of the investigated rivet connections reduce the useful life expectation of the blades and respective disk. Furthermore, deformations of both rivet heads caused by centrifugal forces and temperature loads are unavoidable, whereby the blade orientations may change causing changed balance states of the rotor disks or of the entire turbine rotor.

Furthermore, the above described rivet connections that have been investigated are likely to cause premature material fatigue in the connections, particularly near the rivet heads. Such fatigue is likely to be due to the movement of the two halves of each countersink relative to each other, thereby causing shearing forces. Such relative movement may, for example be caused by tension loads on the blade feet.

OBJECTS OF THE INVENTION

In view of the above it is the aim of the invention to achieve the following objects singly or in combination:

- to provide a rivet connection for securing the blade feet to the rotor disk which avoids the above problems, yet assures a high operational safety while simultaneously facilitating assembly and maintenance work;
- to provide a rivet connection which does not cause any mechanical component changes on the rotor blades nor on the rotor rim;
- to avoid divided countersinks for the rivet head so that an exact, precise rivet connection is assured;
- to avoid countersink operations on the disk faces and at the blade foot ends entirely;
- to make sure that the removal of a rivet connection, e.g. for maintenance work, does not damage the body of the disk nor the blade foot;
- to provide a rivet connection which is equally applicable to blade foot receiving grooves that extend axially relative to the rotational axis of the respective rotor disk or that extend at a slant to the rotational axis;
- to provide a positive guide for the rivet shaft when it is inserted into the above mentioned gap;
- to secure the blade foot in the rotor rim groove in an axial and radial direction to thereby substantially eliminate any play;
- to simplify or at least minimize the need for a balancing operation of the finished rotor disk with its blades attached thereto; and
- to seal the grooves at one or both groove ends with the help of the rivet connection.

SUMMARY OF THE INVENTION

The above objects have been achieved according to the invention by a rivet connection which is characterized by the following features. A gap is provided in each groove in the rim of the rotor disk between the bottom of the groove and the radially inwardly facing end of the respective blade foot. This gap will extends axially and parallel to the rotational axis of the disk if the respective groove is an axial groove. The gap will extend with its longitudinal axis at a slant to the rotational axis of the rotor disk if the respective groove also extends at such a slant to the rotation axis of the rotor. Preferably the length axis of the groove and the length axis of the gap extend parallel to each other. A rivet shaft is arranged in the gap and each rivet has an original swaged head and a riveted or locking head. A seating washer is provided for each rivet head. By forming the rivet locking head, both rivet heads are pressed against the respective facing surface of the wheel rim and against the end surface of the respective blade foot through the seating washers. Thus, countersinks in the rim faces and in the blade foot ends are avoided and a uniform distribution of the compression forces is achieved. The washers on each side of the disk rim could be replaced by a single ring provided with holes for the rivets, whereby all rivet heads on one side of the rim bear against the same washer or seating ring. The same applies for the opposite side of the rim. According to a preferred embodiment of the invention countersink recesses are formed directly in the seating washers or ring to receive both rivet heads. However, basically such countersink recesses are required only for flat rivet heads, but are not required for round head rivets. Where seating washers are used each washer is an element closed in itself. Therefore, the countersink recesses are not interrupted and the conical seating surfaces are closed, uninterrupted surfaces which assure a precise fit for the conical rivet head surface. The same applies to countersink recesses in a continuous, uninterrupted washer ring. Furthermore, each washer or the entire ring rests with a precise flat surface against the respective flat disk rim surface and against the respective blade foot end surface which is also flat, thereby providing a precise rivet joint or connection.

According to the invention it is possible to mill or drill the countersink recesses separately in each individual washer or separately or simultaneously in a washer ring, whereby any risks of damaging the blade feet and/or the disk rims are avoided. Even if a washer itself should be damaged by the countersinking operation, the loss is minimal because each individual washer is easily exchangeable and relatively inexpensive so that damaged washers can be discarded as scrap metal.

Furthermore, any removal of a rivet head, for example by drilling damages merely the washer, but not the rotor disk, nor the respective blade foot. Thus, maintenance work can be easily performed by removing one of the rivet heads by drilling. Thus, a damaged rivet can be easily withdrawn by pulling the other washer, whereby the drilled washer in which the rivet head has been removed, simply falls off the respective rivet shaft end.

The rivet connection or joint according to the invention is equally useful in turbine rotors wherein the length of the blade foot extends in parallel to the rotational axis of the rotor disk and when the longitudinal blade foot axis extends with a slant relative to the rotational rotor axis. In the latter embodiment the washers are merely shaped in such a way that the washers have different thicknesses at diametrically opposite portions of the respective washer, whereby the washer has a somewhat wedge-shaped cross-section. Further, the guiding of the rivet shaft in the gap may be facilitated by providing the washers with guide tongues extending into the gap space. In the embodiment in which the washers are provided with a varying thickness over the washer cross-section these washers can also be provided with guide tongues, whereby the position and orientation of the countersink recesses and of the guide tongues will be adapted to the respective slant of the longitudinal gap axis relative to the rotational axis of the rotor disk.

The operational safety of the rivet connection according to the invention is optimized if the rivet shaft is guided in the gap in a positive manner and held centrally in the gap by respective guide tongues, bushings or supports. In these embodiments it is preferred that the respective disk groove contour is not changed and not exposed to any adverse tension loads. For this purpose is it preferred that the rivet shaft is properly guided within the gap. In one possible embodiment for guiding the rivet shaft the radially inwardly facing end of the blade foot is provided with a longitudinal recess having a cross-section that positively embraces at least part of the circumference of the rivet shaft. For example, the longitudinal recess may have a triangular cross-section or a semicircular cross-section for contacting the cylindrical surface of the rivet shaft, whereby the rivet shaft is coupled, so to speak, to the blade foot.

However, it is also possible to positively guide the rivet shaft while the rivet shaft is decoupled from the blade foot. In this embodiment the positive guiding and holding of the rivet shaft in the gap is accomplished by guide tongues extending into the gap and having an outer contour which substantially fills the space in the gap on both sides of the rivet shaft to positively guide and hold the rivet shaft. The guide tongues are preferably integral parts of the respective washer or washer rings.

The above described features of the invention achieve the important advantage that countersinks directly in the rim side surfaces and in the blade foot ends are avoided. Further, the present rivet heads no longer directly bear against surfaces of two different elements. Each rivet head only bears against the surface of one element, namely the washer or washer ring providing a uniform load distribution. Another advantage of the invention is achieved in that manufacturing tolerances can be compensated by a tilt deformation of the respective washer by the riveting operation.

Still another advantage of the invention is seen in that the present rivet connection assures in addition to the axial locking of the blades to the rotor disk, an optimal radial fixation of the disks in the respective groove by pressing the blade feet radially outwardly against the serrations in the rotor rim groove. This radial outward biasing of the blade feet in the grooves assures a secure anchoring of the blades to the rotor disk so that any initial manufacturing tolerances between the cooperating intermeshing or interlocking surfaces of the foot serrations and the respective serrated counter surfaces in the groove are reduced substantially to zero already when the rotor is in its rest position and does not rotate. As a result, the rotor blades remain in their original installed position even when the rotor rotates and centrifugal forces are substantial. This advantageous feature of the invention is especially desirable in rotors provided with a radially outer shroud band ten sioning of the rotor blades and with regard to the desired balancing of the rotor disk with its rotor blades provided with the shroud band tensioning. In conventional rotors the shroud band tensioning or clamping normally causes irregular blade positions which in turn cause disk or rotor unbalances. Heretofore, it was frequently impossible to balance a shroud band tensioned rotor even if balancing operations were repeated several times.

Another advantage of the present washers is seen in that at least one washer, preferably both washers, can be constructed as a secondary seal for the grooves in the rotor rim. This sealing feature is also provided by the washer ring or rings.

The positive holding and guiding of the rivet shaft by washer or ring extensions forming guide shafts that reach from one or both sides of the rotor disk into the gap can be easily provided with a sectional configuration corresponding to the local foot and groove contour in order to assure the desired mutual surface contact between the groove and foot contours that mesh with each other. These surface contacts in turn assure a safe operation. The operational safety of the present rivet connections can be further increased by providing the guide tongues additionally with longitudinal depressions or longitudinal flutes in which the contour of the rivet shaft is received.

BRIEF DESCRIPTION OF THE DRAWINGS

In order that the invention may be clearly understood, it will now be described, by way of example, with reference to the accompanying drawings, wherein:

FIG. 2 is a sectional view along section line II—II in

FIG. 1, however on a somewhat smaller scale than in FIG. 1;

DETAILED DESCRIPTION OF PREFERRED EXAMPLE EMBODIMENTS AND OF THE BEST MODE OF THE INVENTION

Figure 1:
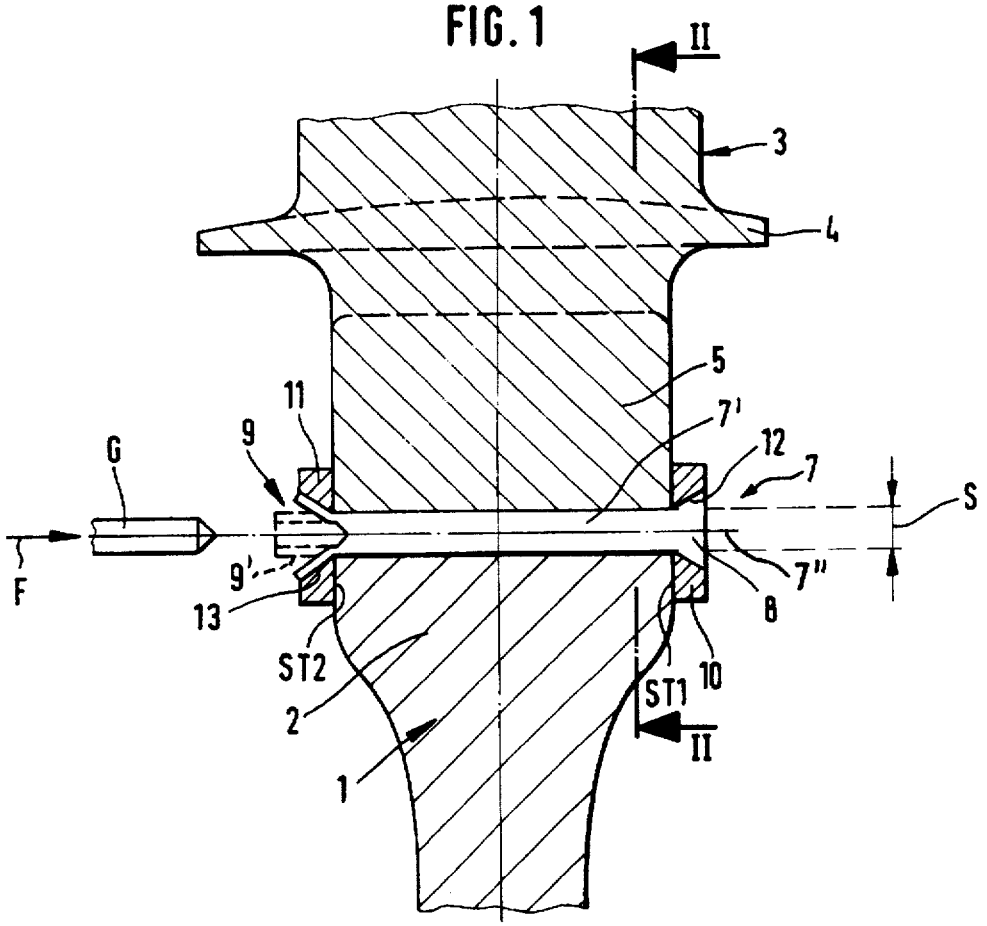
FIG. 1 is a radial sectional view through the longitudinal axis of a rivet connection according to the invention securing a blade foot to a rotor disk rim.
Figure 2:
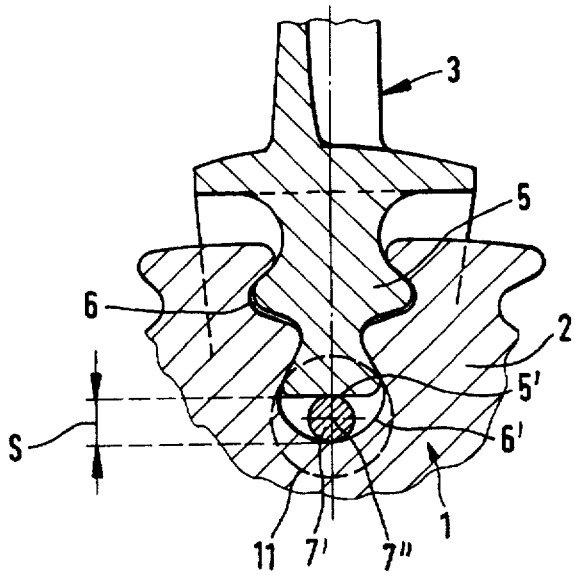

FIGS. 1 and 2 illustrate a rotor disk 1 of a gas turbine rotor having a rotor rim 2 for carrying a plurality of rotor blades 3 connected to the rotor rim 2 through a blade foot 5 secured to the respective blade 3 through a foot or root plate 4. For this purpose the blade foot 5 has a serrated configuration which intermeshes with corresponding serrations in the groove 6 of the rotor rim 2. A plurality of grooves 6 are uniformly circumferentially spaced around the rotor rim. The intermeshing serrations of the blade foot 5 and of the groove 6 hold the blade 3 in a radial direction against centrifugal forces. The securing against axial forces is accomplished by a rivet connection 7 according to the invention. The rivet connection 7 comprises two rivet heads 8 and 9 interconnected by a rivet shaft 7' having a longitudinal shaft axis 7". A gap S is provided between the bottom 6' of the groove 6 and the downwardly facing sole 5' of the blade foot 5. The rivet shaft 7' is received in this gap S.

As shown in the example, the original or swaged rivet head 8 is a flat head received according to the invention in a conical countersunk recess 12 of a washer 10 bearing in part against the side surface ST1 of the rotor rim 2 and in part against the respective axial end surface of the blade foot 5. The other end of the rivet connection 7 comprises a hollow rivet head 9 which, prior to the riveting operation, is a hollow cylindrical portion 9' of the rivet shaft 7'. The cylindrical portion 9' is deformed by a tool G driven by a force F to expand the cylindrical portion 9' into the hollow head 9 that bears against a conical countersunk recess 13 in a further washer 11. The washer 11 bears partly against the opposite flat surface ST2 of the rotor rim 2 and partly against the respective axial end surface of the blade foot 5, thereby securing the rotor blade 3 against axial displacement. Round rivet heads could be used instead of the flat rivet heads. In that case the countersink recesses are not necessary. The same applies to the embodiment in which all washers on both sides of the rim 2 are replaced by two washer rings. Thus, these washer rings could have two flat surfaces or one flat surface bearing partly against the rim side surface and a second opposite surface provided with the countersink recesses.

Figure 12:
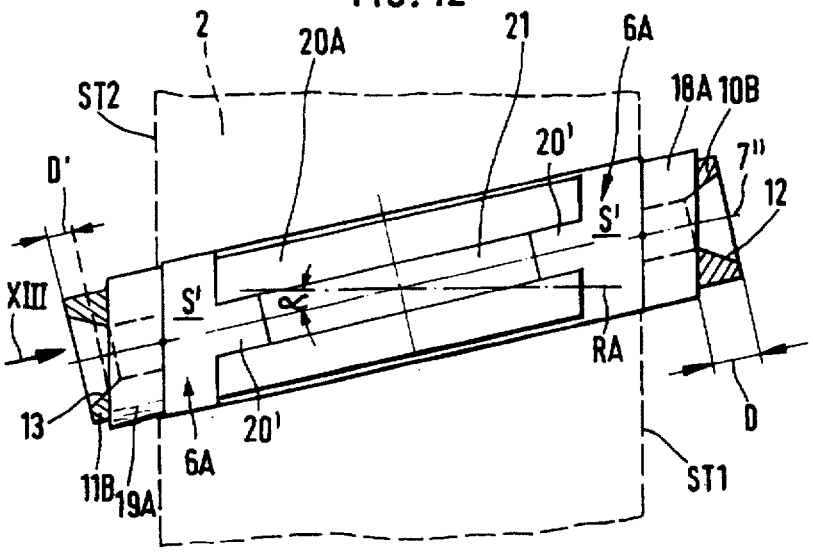
FIG. 12 illustrates a view in a radial direction onto a developed plane of a modified embodiment in which the longitudinal axis of the rivet shaft extends at a slant relative to the rotational axis of the rotor disk.
Figure 13:
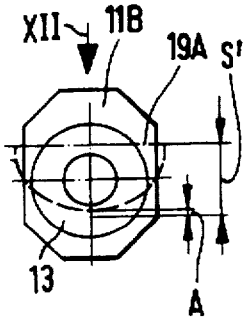
FIG. 13 is a view in the direction of the arrow XIII in FIG. 10.

Incidentally, with the exception of FIGS. 12 and 13, it is assumed, that in the other figures the longitudinal axis 7" of the rivet shaft 7' extends in parallel to the rotational axis RA of the rotor disk. In FIGS. 12 and 13 the rivet shaft axis 7" extends at a slant relative to the rotational axis RA of the rotor disk 1. Similarly, the groove 6 and the gap S also extend with their longitudinal axes at a slant relative to the rotational axis RA in the embodiments of FIGS. 12 and 13.

For the application of the teaching of the invention, it is essential that each rivet head 8 and 9 bears against a respective washer 10 or 11 a respective washer ring. When flat head rivets are used the countersink recesses are so dimensioned that the flat head surfaces are flush or even recessed in the corresponding countersink recesses 12 and 13. These recesses have a conical contour which corresponds to the respective given contour of the respective rivet heads 8 and 9.

The installation of the rivet connection 7 can be accomplished as follows. It is assumed that a blade foot has been inserted into the rotor rim groove. Then, the washer 10 is placed onto the rivet until the head 8 is received in the recess 12. Then the rivet shaft 7' is inserted from right to left in FIG. 1 until the left-hand hollow rivet end 9' of the rivet shaft protrudes from the second side surface ST2 of the rotor rim 2. Then, the second washer is placed onto the protruding shaft end 9'. Then the second closing rivet head 9 is formed by the application of the tool G for example with hammer blows while the rivet head 8 rests on a counterholder. Once the head 9 is formed, the rivet connection is axially locked and so is the respective blade foot 5 against axial displacement since parts of the washers 10 and 11 bear against the axially facing end surfaces of the blade foot 5.

Removal of the rivet connection 7, for example for maintenance work or for replacing a blade, one of the rivet heads, preferably the locking head 9, is drilled out to such an extent that the washer 11 can be removed. Thereafter the washer 10 with the swaged head 8 can be pulled out from left to right in FIG. 1.

Figure 3:
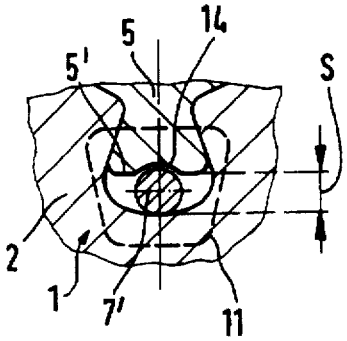
FIG. 3 is a view similar to that of FIG. 2, but showing a different contact configuration between the cylindrical shaft of the rivet and the radially inwardly facing surface or foot sole of the blade foot.

Rather than performing a manual cold formation of the rivet head 9 it is also possible according to the invention to employ hydraulically, pneumatically or electrically operated riveting tools. In both instances the riveting operation results in a desirable upsetting of the rivet shaft 7' in the radial direction. Such radial upsetting of the rivet shaft assures a strong setting of the rivet connection 7 in the radial and axial direction because the radial force component pushes the foot serra tions and the groove serrations against each other to achieve a uniform surface area contact of the intermeshing surface areas in the rotor rim groove. FIGS. 2 and 3 show that the washer 11 can have a circular configuration as shown by a dashed line circle in FIG. 2 or a rectangular configuration as shown in FIG. 3. The same applies to the washer 10. The square or rectangular washer configuration with rounded corners shown in FIG. 3 normally provides a desirably larger contact surface area between the washer and the rim side surface, and between the washer and the axially facing foot end surface than the circular configuration of the washer. Thus, the rectangular configuration can take up larger axially effective forces. The selection of the washer configuration and dimension or of the washer ring dimension will thus take into account the size of the particular rotor. Further, the larger washer surface area can be effectively utilized to provide a secondary seal for the gap S and for the groove 6.

In FIG. 2 the downwardly facing sole 5' of the foot 5 bears against the cylindrical surface of the rivet shaft 7' substantially along a line. Contrary thereto in FIG. 3 the downwardly facing sole 5' of the foot 5 is provided with a longitudinal trough 14 which partly encircles the surface of the rivet shaft 7'. The trough 14 does not have to have a circular arc cross-section. Other cross-sections such as a triangular cross-section may be used for contacting and guiding the cylindrical surface of the rivet shaft 7'. With such a contact between the sole 5' of the foot 5 and the cylindrical surface of the rivet shaft 7' an exact centric guiding of the rivet shaft through the gap S is achieved.

Figure 4:
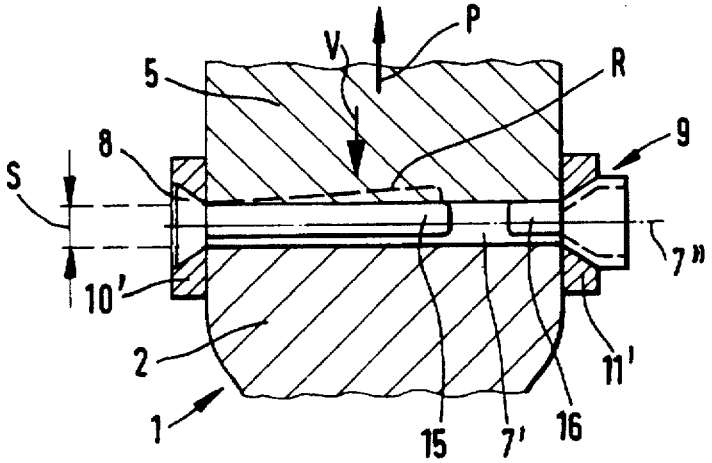
FIG. 4 is a sectional view similar to that of FIG. 1 illustrating washers with guide tongues reaching into the gap between the bottom of the rotor rim groove and the radially inwardly facing foot surface, or foot sole whereby a dashed line shows the longer left-hand guide tongue in a tensioned position prior to setting the rivet.
Figure 5:
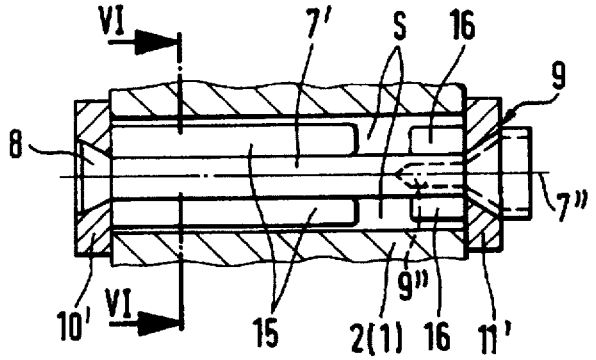
FIG. 5 is a sectional view in the direction of the arrow V in FIG. 4 in a horizontal plane through the longitudinal axis of the rivet shaft.

In the embodiment of FIGS. 4 to 7, the washers 10 and 11 have been replaced by washers 10' and 11' provided with axially extending guide tongues or extensions 15 and 16 respectively. The extensions 15 and 16 form an integral part of the respective washer 10', 11'. The guide tongues 15 have a substantial length relative to the axial length of the gap S but are still shorter than the gaps S. The guide tongues 16 are substantially shorter than the gap S. In any event, the axial length of the guide tongues 15, 16 will be sufficient to achieve the intended axial guiding and holding of the rivet shaft 7'. As shown in FIGS. 4 and 5 the combined length of the guide tongues 15 and 16 will contact the rivet shaft 7' over most of its length in the gap S. It is preferable to use the washer 11' with the shorter guide tongues 16 at the locking head 9 for an easier removal of the rivet when the locking head 9 is drilled out for maintenance or replacement work. The locking head 9 in FIG. 5 is formed by a hollow portion at the end of the rivet shaft 7' as described above with reference to FIG. 1. However, an axial bore 9" in FIG. 5 extends axially further into the rivet shaft 7' than in FIG. 1. The deeper bore 9" facilitates the removal of the locking head 9 by drilling without damage to the rim and/or foot.

Figure 6:
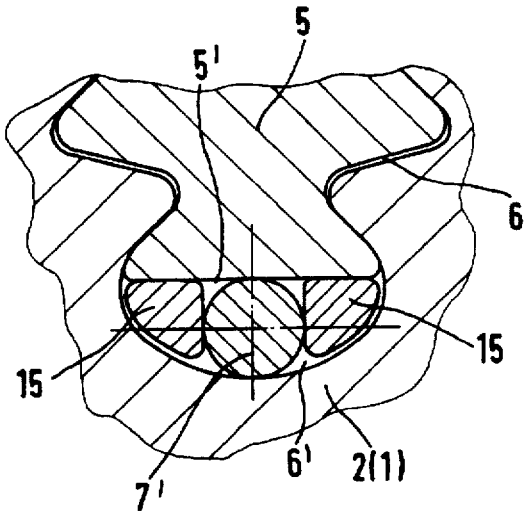
FIG. 6 is a sectional view along section line VI—VI in FIG. 5, showing the two rivet shaft guide tongues of one of the washers on a somewhat enlarged scale compared to FIG. 5.
Figure 7:
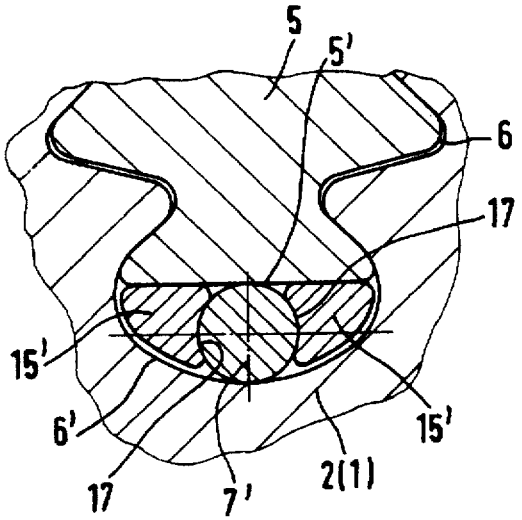
FIG. 7 is a view similar to that of FIG. 6, but showing washer guide tongues with a modified cross-sectional contour for partially encircling the cylindrical surface of the rivet shaft.

The guide tongues 15 and 16, but particularly the longer guide tongues 15 have a cross-sectional configuration as shown in FIG. 6, whereby plane or flat surfaces rest against the foot sole 5' and against the rivet shaft 7' while curved or circular arc surfaces of the guide tongues 15 are slightly spaced from the bottom of the groove in the gap S as shown in FIG. 6. The same substantially applies to the embodiment of FIG. 7 where the guide tongues 15' rest with a flat surface against the corresponding flat surface of the foot sole 5' while curved surface troughs 17 rest against the cylindrical surface of the rivet shaft 7'. The outwardly facing curved or circular arc surfaces of the guide tongues 15' are again slightly spaced from the bottom surface of the groove in the gap as shown in FIG. 7. The guide tongue surfaces contacting the rivet shaft 7' hold and center the shaft 7' especially when these surfaces are curved as shown at 17 in FIG. 7.

FIG. 5 also shows that the shorter guide tongues 16 are radially somewhat smaller dimensioned than the longer guide tongues 15. This feature again facilitates the removal of the washer 11' with its guide tongues 16 when the closing or locking head 9 has been drilled out. However, generally the cross-sectional configuration of the shorter guide tongue 16 can have the same form as the longer guide tongues 15.

The basic advantage of the embodiment illustrated in FIGS. 4 to 7 is seen in that the relatively long guide tongues 15 can be prestressed or bent prior to insertion into the gap S as shown by the dashed line R in FIG. 4 to provide a biasing force component P that is radially effective on the fixed, mounted rivet connection 7. The prestressing of the guide tongues 15 relative to the rivet axis 7" is such, that the foot 5 is biased radially outwardly even in a rest position when the rotor does not rotate. Thus, the biasing force P assures that the feet 5 and thus the blades 3 are rigidly mounted substantially without any radial play of the feet 5 in the grooves 6 even during balancing operations.

Figure 8:
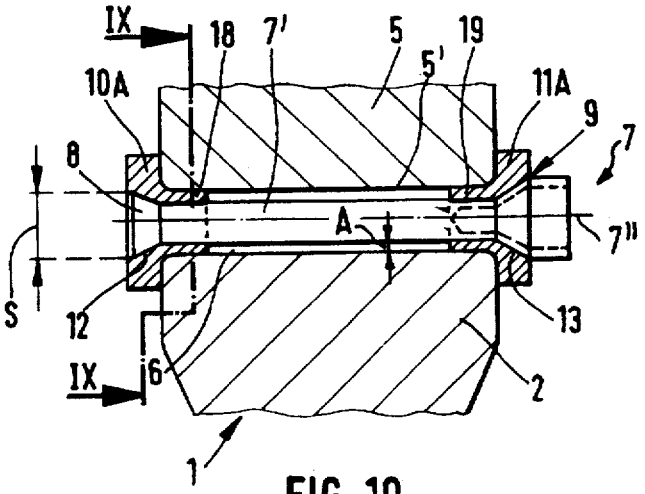
FIG. 8 shows a sectional view of a modified embodiment in which each washer is provided with a rivet shaft guide bushing which completely encircles the rivet shaft.
Figure 9:
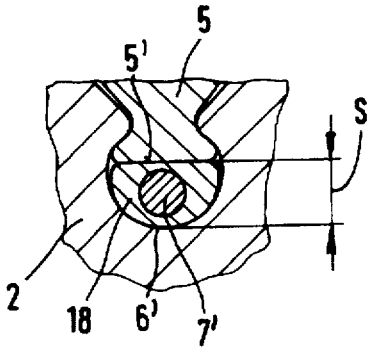
FIG. 9 is a sectional view along section line IX—IX in FIG. 8.

In the embodiment of FIGS. 8 and 9 each washer 10A and 11A comprises an integral bushing 18, 19, respectively, functioning as a guiding, centering, and holding device for the rivet shaft 7'. These bushings 18, 19 have a coaxial bore for receiving the rivet shaft 7' but their cross-sectional configuration is not circular. Rather, the cross-sectional configuration of the bushings 18, 19 has the shape of a circular segment that is preferably extending over more than 180° to provide a flattened surface resting against the sole 5' of the respective foot 5 as best seen in FIG. 9. The bores through the bushings 18 and 19 extend coaxially to the conical countersink recess 12 and 13 of the respective washer 10A, 11A. Once the locking rivet head 9 has been set, both bushings 18, 19 become part of the rigid rivet connection 7 including the respective washers 10A and 11A. The configuration of the holding and guide bushings 18 and 19 is such that an interlocking form-transmitting connection between the rivet shaft and the surfaces facing into the gap S is established in the gap S by a wedging action caused by said cross-sectional configuration of the bushings.

Figure 10:
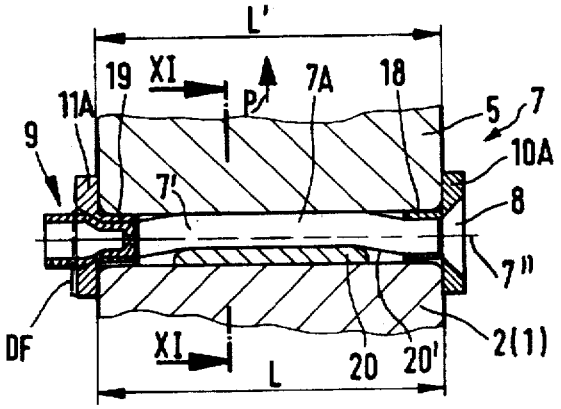
FIG. 10 is a sectional view illustrating an insert in the groove for radially stressing the rivet shaft, whereby the riveting operation results in an axial and radial stressing of the rivet connection.
Figure 11:
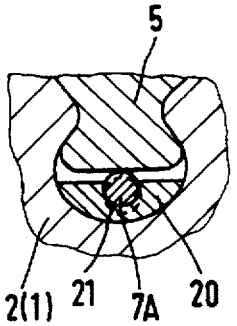
FIG. 11 is a sectional view along section line XI—XI in FIG. 10 to illustrate the cross-sectional trough shape of the insert.

In the embodiment of FIGS. 10 and 11, it is still assumed that the rivet connection 7 extends with its longitudinal geometric central axis 7" in parallel to the rotational axis of the rotor disk 1. However, a radially outwardly effective biasing force P has been imposed by bending the central rivet shaft portion 7A radially outwardly with the help of an insert 20 in the gap S. For this purpose the insert 20 has a cross-sectional configuration as seen in FIG. 11 biases the blades foot 5 radially outwardly to thereby reduce of eliminate radial play between the blade foot 5 and the rotor rim or hub 2. The washers 10A and 11A in FIG. 10 are substantially the same as in FIG. 8, except that in FIG. 10 the bushings 18 and 19 of the washers are shorter to just hold the end portions of the rivet shaft 7', whereby the central shaft portion 7A is available for bending as shown in FIG. 10. Due to the radial bending of the central rivet shaft portion 7A, it is possible that one or both washers 10A, 11A, is deformed as shown at DF to compensate for manufacturing tolerances. The insert 20 has an axially extending groove 21 as shown in FIG. 11. The downwardly or radially inwardly facing surface of the central portion 7A of the rivet shaft 7' is received at least partly in the groove 21. The depth of the groove 21 is such that preferably at least a segment of 180° of the shaft portion 7A is received in the groove 21. Preferably bottom end portions 20' of the insert 20 are cut, please also see FIG. 12, to provide space for the bent portion of the rivet shaft 7' that connects the radially deflected central portion 7A with the shaft end portions. Without these cut-outs 20' it would be difficult to bend the central shaft portion 7A radially outwardly.

In FIGS. 10 and 11 the bushings 18 and 19 function in the same manner as has been described above with reference to FIGS. 8 and 9. As shown in FIG. 8, a spacing A between the bottom surface of the groove 6 and the shaft 7' between the bushings 18, 19 corresponds to the wall thickness of the respective bushing 18, 19. This spacing A, which is also shown in FIG. 13, helps inserting the insert 20 for bending the central shaft portion 7A when the riveting operation is performed. Since the bushings 18 and 19 completely surround the respective shaft portion, their radially outwardly positioned wall section spaces the shaft end portions from the foot sole 5', thereby also facilitating the bending of the central shaft portion 7A as shown in FIG. 10.

The insert 20 has been shown as a trough with a central groove 21 having a cross-section as shown in FIG. 11, wherein the groove 21 forms the trough 20 as a radially outwardly open trough having; for example a cross-section in the form of an elliptical segment with cut-out bottom portions 20', at the insert ends, also seen in FIG. 12. The cut-out portions 20' are cut out of insert end sections having a wall thickness increasing toward the center portion of the insert 20, whereby the wall of the center portion is thicker than the wall of the end sections forming ramps as best seen in FIG. 10. The insert 20 may have other configurations, for example one with a sickle-shaped cross-section. The thickest part of the sickle cross-section would be positioned where the central shaft portion 7A is to be eccentrically deformed. By rotating the sickle insert in the gap S, it is possible to position the thickest portion of the sickle insert where the largest radial deformation of the central rivet portion 7A is intended. Similarly, the insert 20 could be a sleeve with a wall that is thicker where it rests on the groove bottom and thinner where it comes to rest against the foot sole 5' when the radial deformation of the central shaft portion 7A is completed. Instead of the somewhat elliptical segment cross-section of the insert 20 shown in FIG. 9 the cross-section could be for example semicircular. Generally, the shape of the insert 20 will conform to the shape of the wall of the groove 6 in the rotor disk rim.

As mentioned above, the localized deformation DF of the washer 11A in FIG. 10 has the advantage that manufacturing tolerances in the local dimensions of the components of the rivet connection 7 are compensated. For example, if the rotor rim should have an axial width L and the blade foot 5 should have a slightly different axial length L', the difference is compensated by a deformation DF or slanting of one or both washers 10A, 11A. FIG. 12 illustrates a view in the direction of the arrow XII in FIG. 13, into a groove 6A of a rotor rim 2 in which the individual blades 5 are inserted with a slant $\alpha$ relative to the rotational axis RA of the rotor 1. Thus, the longitudinal rivet axis 7" also extends at the same slant $\alpha$ relative to the rotational axis RA. The construction of the embodiment of FIG. 12 is substantially the same as that shown in FIG. 10, except that in FIG. 12 the blades 5 are arranged with the just mentioned slant $\alpha$ at uniform angular spacings around the circumference of the rotor rim 2. Due to this slant $\alpha$ the groove 6A and the gap S' are also slanted at the same slant $\alpha$ relative to the rotational axis RA. Since the side faces ST1 and ST2 extend in parallel to each other, it is necessary that the bushings 18A and 19A and the washers 10B and 11B are configured to accommodate the slant $\alpha$. The same applies to the insert 20A. The just mentioned elements are shown in FIGS. 12 and 13 in a position prior to the insertion of a rivet and prior to the rivet formation.

In FIGS. 12 and 13 the washers 10B and 11B have a wedge-shaped cross-section with a larger axial width D at one side of the washer and a smaller axial width D' at the other, opposite washer side. The washer thickness changes gradually from D to D' on one side of the washer to the opposite side to accommodate the slant $\alpha$. The bushings 18A and 19A have a parallelogram cross-sectional configuration, whereby the respective countersunk recess 12 and 13 reaches partly into the respective bushing 8A, 19A. The insert 20A has a configuration such that the axially facing insert end surfaces extend in parallel to the inwardly facing surfaces of the bushings 18A and 19A whereby the insert end surfaces extend in parallel to the rim side faces ST1 and ST2 as shown in FIG. 12. The cut-outs 20' of the insert 20 are the same as described above with reference to FIG. 10.

FIG. 13 shows a view in the direction of the arrow 13 in FIG. 12, but omitting the rotor rim 2. The washer 11B has an elongated octagonal configuration and the respective bushing 19A may have a cross-sectional configuration similar to that shown in FIG. 9, for example. The just described elements are not yet riveted together in FIGS. 12 and 13 so that the bushings 18A and 19A are shown outside the side walls of the rim 2. After inserting a rivet, the bushings 18A and 19A are pushed into the gap sec tions S' and the riveting is completed as described above. The insert 20A will also provide the radial biasing forces as shown by the arrow P in FIG. 10 upon completion of the riveting operation.

Figure 14:
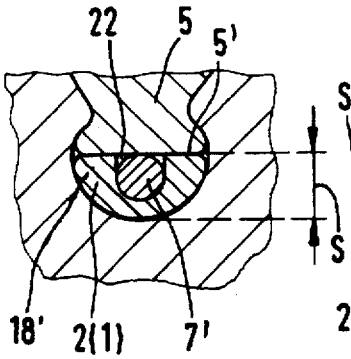
FIG. 14 is a sectional view similar to FIG. 11 illustrating a guide and support extension of the respective washer, whereby the extension forms a radially outwardly open semicircular trough in which the rivet shaft is held.
Figure 15:
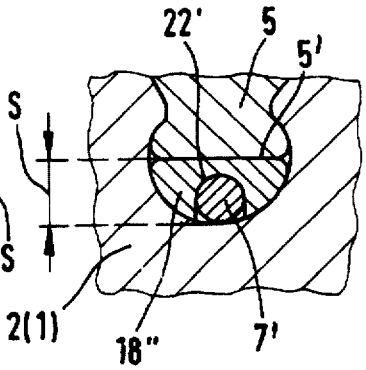
FIG. 15 is a view similar to that of FIG. 14, but showing a modified cross-sectional configuration of the washer extension for guiding and holding the rivet shaft.
Figure 16:
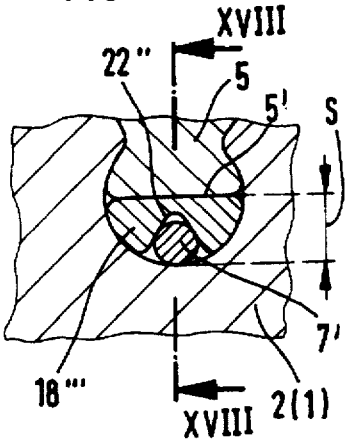
FIG. 16 is a sectional view similar to that of FIGS. 14 and 15, but showing a further cross-sectional modification of the washer extension for guiding and holding the rivet shaft.

FIGS. 8 to 13 show the various rivet bushings 18, 19; 18A, 19A as an integral part of the washers for guiding, centering, and holding of the rivet shaft 7' FIGS. 4 to 7 show washers with axially extending tongues 15, 16, 15' that perform the function of the bushings. FIGS. 14, 15 and 16 show further modified washer extension sections 18', 18", 18'" extending axially and forming integral parts of the respective washers while also functioning in the same manner as the above described inserts 20. These elements 18, 18", and 18'" perform the same functions as the bushings and the tongues for guiding, centering, and holding the rivet shaft 7'. In FIG. 14 the support section 18' forms a trough with a radially outwardly open groove 22 in which the rivet shaft 7' is supported. FIG. 15 shows a washer extension section 18" having a cross-sectional configuration similar to that of the section 18', but with a groove 22' that opens radially inwardly to hold the rivet shaft 7' FIG. 16 shows a support section 18'" which has a radially inwardly open groove as in FIG. 15. However, in FIG. 16 the groove 22" has an approximately triangular cross-section. These sections 18', 18", and 18'" may be used either for the washer 10 holding the original rivet head 8 and/or for the washer 11 holding the closing or locking head. The sections have an outer contour matching the contour of the blade foot sole 5' and the contour of the groove 6. The trough 22, 22', and 22" has a configuration to efficiently contact the rivet shaft 7' and to center and guide the shaft. In the embodiment of FIG. 16 the surfaces forming the trough 22" contact the rivet shaft tangentially to thereby center and guide the rivet shaft in the gap S.

An insert as shown at 20 in FIG. 10 or at 20A in FIG. 12 may be used in the embodiments of FIGS. 14, 15 and 16 provided the sections 18', 18", and 18'" are sufficiently short in the axial direction to provide space for the insert.

Figure 17:
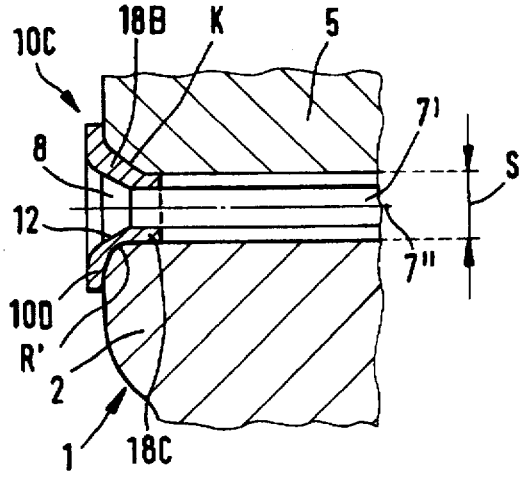
FIG. 17 shows a sectional view similar to that of FIG. 8, however with a modified washer having a flange section, a conical section, and a cylindrical section reaching into the gap, whereby the conical section has an outer wall configuration adapted to a chamfer along the blade foot end and to the rounded rim edge of the rotor disk.
Figure 18:
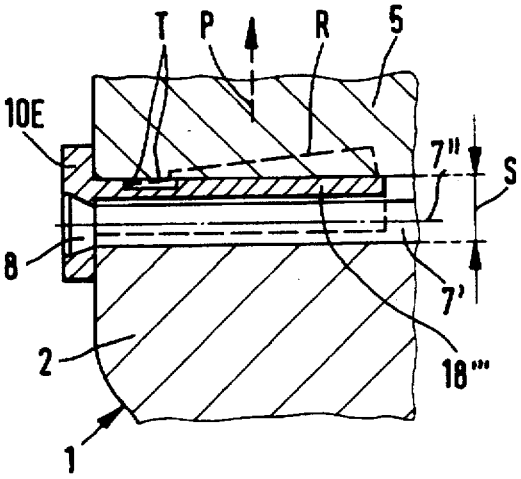
FIG. 18 is a sectional view along section line XVIII—XVIII in FIG. 16 illustrating a deformation of a washer extension for a radial tensioning of the rivet connection.

FIG. 17 illustrates a washer 10C that differs from the bushing washer of FIG. 8. The washer 10C has three sections namely a washer flange 10D, an intermediate wall section 18B, and a bushing section 18C. The intermediate wall section 18B has a conical wall portion K on one outer side and a curved wall portion R' on the opposite outer side. The conical wall portion K accommodates a respective cross-sectional configuration of the end of the blade foot 5. The curved wall portion R' accommodates a respective edge of the rotor rim 2. the Bushing section 18C guides, centers, and holds the rivet shaft 7' as described above. The washer 10C is so constructed that the material of the intermediate wall section 18B will be sufficient to also form the countersink recess 12 for the rivet head 8. The recess 12 may be deep enough in the direction of the axis 7" to locate the rivet head 8 inside the gap S or at least substantially inside the gap when the riveting operation is completed. FIG. 18 shows a washer 10E with a centering and holding section 18'" as shown in FIG. 16. The section 18" has an axial length that is relatively long as compared to the axial length of the gap S. The washer 10D holds the original rivet head 8. The opposite side of the rivet connection 7 is provided with a washer having a shorter guide bushing or guide tongue as described above.

In FIG. 18 the centering and support section 18'" is prestressed as shown at R in dashed lines similar to the illustration in FIG. 4. This prestressing provides in the built-in rivet connection 7 a radially outwardly effective biasing force component P, whereby play between the intermeshing serrations of the blade foot 5 and the groove 6 are substantially eliminated. To facilitate the prestressing of the guide and centering section 18'" the latter is provided with a recess T facing radially upwardly. Further, the radially outward flange portion of the washer 10E is longer than the radially inward flange portion to fully cover the axial blade foot end surface.

Figure 19:
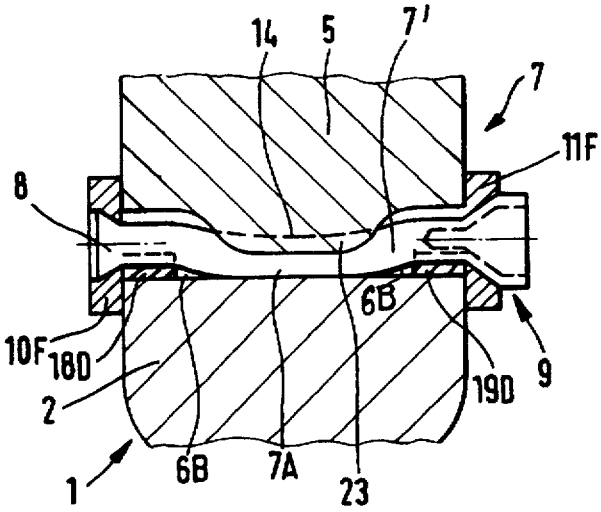
FIG. 19 is a sectional view of a further modification for radially stressing the rivet shaft to provide, upon completion of the riveting operation, an axial and a radial force component of the rivet shaft for eliminating play between the blade foot and the rotor disk.

FIG. 19 shows an embodiment in which the rivet shaft 7' is bent radially inwardly in the gap S. For this purpose, the blade foot sole of the blade foot 5 is provided with a radially inwardly extending bulge 23 provided with a groove 14 that also faces with its open side radially inwardly. The rivet shaft 7' is guided in the groove 14 and pressed downwardly against the bottom of the groove 6 in the rim 2. This eccentric deformation of the rivet shaft 7' also provides a desirable radial biasing force that minimizes or eliminates play between the intermeshing surfaces of the foot 5 and the grooves 6 in the radial direction. The groove 14 is respectively curved to conform and partially surround the center portion 7A of the rivet shaft 7'. The support sections 18D and 19D form an integral part of the washers 10 and 11 are axially relatively short in the embodiment of FIG. 19 to provide a groove space 6B near the groove bottom so that the rivet shaft 7' can be bent radially inwardly. These spaces 6B in FIG. 19 thus function similar to the cut-outs 20' from the insert 20 in FIG. 10 or from the insert 20A in FIG. 12. Once the riveting operation in the embodiment of FIG. 19 is completed, an axial and radial rigid locking of the blade with its foot 5 in the groove 6 is assured since play between the intermeshing serrated surfaces is eliminated. Support sections other than those shown at 18D and 19D may be used in the embodiment of FIG. 19 provided that a radially inwardly effective support leaves the spaces 6B for permitting the rivet shaft 7' to be bent radially inwardly.

Where any of the washers or washer members are replaced by one washer ring on each side of the rotor disk, these rings are simple rings either with flat sides for round head rivets or with conical recesses 12, 13 in one ring side facing away from the respective rim surface T2 and ST2.

Although the invention has been described with reference to specific example embodiments, it will be appreciated that it is intended to cover all modifications and equivalents within the scope of the appended claims.

What is claimed is:

1. A device for securing a rotor blade having a blade foot with axial blade foot end faces and with a blade foot sole (5') in a blade mounting groove of a rotor disk having a rotor rim with axial rim side surfaces, said blade mounting groove having a groove bottom in said rotor rim and groove side surfaces intermeshing with blade foot side surfaces, comprising a gap (S) with open ends in said blade mounting groove (6) between said foot sole (5') and said groove bottom (6'), a rivet (7) with a rivet shaft (7') in said gap (S), said rivet shaft comprising a first rivet head (8) at one end of said shaft, a second rivet head (9) at the other end of said rivet shaft (7'), and a washer member (10, 11, . . . ) between each rivet head and a respective axial rim side surface of said axial rim side surfaces, wherein two washer members forming a pair are so dimensioned that a rim facing washer surface bears partly against one of said axial rim side surfaces and partly against one of said axial end faces of a respective blade foot when a riveting operation is completed, wherein said first rivet head is a holding head (8) forming part of said rivet (7) prior to said riveting operation, wherein said second rivet head is a locking head (9) formed as part of said riveting operation, said rivet shaft (7') comprising a hollow end section (9') for forming said locking head (9) in said riveting operation, wherein at least one of said washer members comprises at least one integral element (15, 16; 18, 19, etc.) extending into said gap (S) for guiding, centering, and holding said rivet shaft (7'), and wherein said at least one washer member comprises two integral elements (15) extending into said gap (S) for guiding, centering, and holding said rivet shaft (7') disposed between said two integral elements (15) which, prior to insertion into said gap (S), are angularly deformed so that after insertion into the gap (S) and completion of said riveting operation, said integral elements (15) exert a radially effective biasing force (P) on said blade foot (5) to minimize play in surface contacts between said blade foot and said mounting groove (6).

2. The device of claim 1, wherein said at least one integral element (15, 16; 18, 19, etc.) for guiding, centering, and holding said rivet shaft in said gap (S) comprises support surfaces for said blade foot sole and centering surfaces for said rivet shaft (7').

3. The device of claim 1, wherein upon completion of said riveting operation at least one washer member of said pair of washer members on said rivet (7) is deformed (DF) for compensating manufacturing tolerances of said blade foot (5), of said rotor rim (2) and of said blade mounting groove (6).

4. The device of claim 1, wherein said integral element for guiding, centering, and holding comprises a washer extension (18, 19) forming an integral part of the respective washer member, said washer extension reaching into said gap (S) and holding said rivet shaft (7') with a spacing (A) from a bottom of said mounting groove.

5. The device of claim 4, wherein said washer including said washer extension (18, 19) reaching into said gap comprises a washer section (10D), an intermediate section (18B), and a bushing section (18C) connected by said intermediate section (18B) to said washer section (10D), said intermediate section (18B) having a first outer surface portion (K) conforming to a respective contour of an axial blade foot end face, and a second outer surface portion (R') conforming to a respective contour of a rotor rim edge at an end of said mounting groove.

6. The device of claim 24, wherein said washer extension (18', 18", 18'") forming an integral part of the respective washer comprises a groove or trough (22, 22', 22") for guiding, centering, and holding said rivet shaft (7'), said groove or trough facing radially outwardly or radially inwardly relative to a rotational axis of said rotor rim.

7. The device of claim 6, wherein said washer extension (18'") forming an integral part of the respective washer member comprises a recess (T) for facilitating prestressing said washer extension prior to insertion into said gap (S) at an angle relative to a longitudinal rivet shaft axis, said prestressing causing said radially effective biasing force component (P) on said blade foot (5) after insertion of said washer extension into said gap (S) and completion of said riveting operation.

8. The device of claim 8, further comprising a conical recess (12, 13) in at least one of said washer members, said conical recess reaching into said washer member extension so that said recess and the respective rivet head extend at least partly into said gap (S).

9. The device of claim 1, wherein at least one of said washer members forms a secondary seal for the respective groove end closed by said washer member in the radial and circumferential direction of said rotor disk rim (2).

10. The device of claim 1, wherein each blade foot (5) has a slanted position at a slanting angle (α) relative to a rotation axis (RA) of said rotor rim (2), and wherein each said washer member has a wedge cross-section with a first thickness (D) at one end and a second smaller thickness (D') at the opposite end, so that each washer member is thicker at one end than at its opposite end, said wedge cross-section having a first surface extending perpendicularly to a longitudinal axis (7") of said rivet shaft (7') and a second surface extending at said slanting angle (α) relative to said longitudinal rivet shaft axis (7"), and wherein each washer member has a countersink recess for receiving a respective one of said first and second rivet heads, said countersink recess extending in the direction of said longitudinal rivet shaft axis (7").

11. The device of claim 10, wherein said countersink recess has a conical surface, and wherein said first and second rivet heads are flat rivet heads received recessed in a respective conical countersink recess.

12. The device of claim 1, wherein said washer members form one continuous, integral washer ring on each side face of said rotor rim.

13. The device of claim 12, wherein said integral washer ring comprises conical countersink recesses circumferentially angularly spaced on-center from each other at the same angular spacing as an on-center spacing between neighboring mounting grooves in said rotor rim (2).

14. A device for securing a rotor blade having a blade foot with axial blade foot end faces and with a blade foot sole (5') in a blade mounting groove of a rotor disk having a rotor rim with axial rim side surfaces, said blade mounting groove having a groove bottom in said rotor rim and groove side surfaces intermeshing with blade foot side surfaces, comprising a gap (S) with open ends in said blade mounting groove (6) between said foot sole (5') and said groove bottom (6'), a rivet (7) with a rivet shaft (7') in said gap (S), said rivet shaft comprising a first rivet head (8) at one end of said shaft, a second rivet head (9) at the other end of said rivet shaft (7'), and a washer member (10, 11, . . . ) between each rivet head and a respective axial rim side surface of said axial rim side surfaces, said washer member being so dimensioned that a rim facing washer surface bears partly against one of said axial rim side surfaces and partly against one of said axial end faces of a respective blade foot when a riveting operation is completed, further comprising an insert (20, 20A) in said gap (S) for bending said rivet shaft (7') radially to impart a radially effective biasing force (P) on said blade foot (5) to minimize play in surface contacts between said blade foot (5) and said mounting groove (6) in said rotor rim.

15. The device of claim 14, wherein said insert (20) has an eccentrically effective central wall thickness which is thicker than cut-out bottom portions (20') of said insert (20) for said radial bending.

16. The device of claim 14, wherein said insert (20) is a half sleeve or half bushing with a groove (21) therein forming a radially outwardly open trough.

17. The device of claim 14, wherein said insert comprises an outer surface contour that conforms to a surface contour of said mounting groove (6).

18. The device of claim 14, wherein said insert (20, 20A) has two cut-outs (20') one at each insert end near axial blade foot ends, said cut-outs (20') permitting bending said rivet shaft by said insert in said riveting operation.

19. The device of claim 14, wherein said insert is formed as a washer extension (18', 18", 18'") which is connected to one of said washer members (10).

20. The device of claim 14, wherein at least one of said washer members forms a secondary seal for the respective groove end closed by said washer member in the radial and circumferential direction of said rotor disk rim (2).

21. The device of claim 14, wherein each blade foot (5) has a slanted position at a slanting angle (G) relative to a rotation axis (RA) of said rotor rim (2), and wherein each said washer member has a wedge cross-section with a first thickness (D) at one end and a second smaller thickness (D')

at the opposite end, so that each washer member is thicker at one end than at its opposite end, said wedge cross-section having a first surface extending perpendicularly to a longitudinal axis (7") of said rivet shaft (7') and a second surface extending at said slanting angle (α) relative to said longitudinal rivet shaft axis (7"), and wherein each washer member has a countersink recess for receiving a respective one of said first and second rivet heads, said countersink recess extending in the direction of said longitudinal rivet shaft axis (7").

22. The device of claim 14, wherein said washer members form one continuous, integral washer ring on each side face of said rotor rim.

23. The device of claim 14, wherein said integral washer ring comprises conical countersink recesses circumferentially angularly spaced on-center from each other at the same angular spacing as an on-center spacing between neighboring mounting grooves in said rotor rim (2).

24. A device for securing a rotor blade having a blade foot with axial blade foot end faces and with a blade foot sole (5') in a blade mounting groove of a rotor disk having a rotor rim with axial rim side surfaces, said blade mounting groove having a groove bottom in said rotor rim and groove side surfaces intermeshing with blade foot side surfaces, comprising a gap (S) with open ends in said blade mounting groove (6) between said foot sole (5') and said groove bottom (6'), a rivet (7) with a rivet shaft (7') in said gap (S), said rivet shaft comprising a first rivet head (8) at one end of said shaft, a second rivet head (9) at the other end of said rivet shaft (7'), and a washer member (10, 11, . . . ) between each rivet head and a respective axial rim side surface of said axial rim side surfaces, said washer member being so dimensioned that a rim facing washer surface bears partly against one of said axial rim side surfaces and partly against one of said axial end faces of a respective blade foot when a riveting operation is completed, and wherein said foot sole (5') comprises a radially inwardly projecting bulge (23) for bending said rivet shaft (7') for applying a radially effective biasing force component (P) to said blade foot (5), and wherein said bulge (23) comprises a groove (14) in which said rivet shaft (7') is received at least partly.

25. The device of claim 24, wherein at least one of said washer members forms a secondary seal for the respective groove end closed by said washer member in the radial and circumferential direction of said rotor disk rim (2).

26. The device of claim 24, wherein each blade foot (5) has a slanted position at a slanting angle (α) relative to a rotation axis (RA) of said rotor rim (2), and wherein each said washer member has a wedge cross-section with a first thickness (D) at one end and a second smaller thickness (D') at the opposite end, so that each washer member is thicker at one end than at its opposite end, said wedge cross-section having a first surface extending perpendicularly to a longitudinal axis (7") of said rivet shaft (7') and a second surface extending at said slanting angle (α) relative to said longitudinal rivet shaft axis (7"), and wherein each washer member has a countersink recess for receiving a respective one of said first and second rivet heads, said countersink recess extending in the direction of said longitudinal rivet shaft axis (7").

27. The device of claim 24, wherein said washer members form one continuous, integral washer ring on each side face of said rotor rim.

28. The device of claim 24, wherein said integral washer ring comprises conical countersink recesses circumferentially angularly spaced on-center from each other at the same angular spacing as an on-center spacing between neighboring mounting grooves in said rotor rim (2).

29. A device for securing a rotor blade having a blade foot with axial blade foot end faces and with a blade foot sole (5') in a blade mounting groove of a rotor disk having a rotor rim with axial rim side surfaces, said blade mounting groove having a groove bottom in said rotor rim and groove side surfaces inter-meshing with blade foot side surfaces, comprising a gap (S) with open ends in said blade mounting groove (6) between said foot sole (5') and said groove bottom (6'), a rivet (7) with a rivet shaft (7') in said gap (S), said rivet shaft comprising a first rivet head (8) at one end of said shaft, a second rivet head (9) at the other end of said rivet shaft (7'), and a washer member (10, 11, . . . ) between each rivet head and a respective axial rim side surface of said axial rim side surfaces, said washer member being so dimensioned that a rim facing washer surface bears partly against one of said axial rim side surfaces and partly against one of said axial end faces of a respective blade foot when a riveting operation is completed, and wherein each blade foot (5) has a slanted position at a slanting angle (α) relative to a rotation axis (RA) of said rotor rim (2), and wherein each said washer member has a wedge cross-section with a first thickness (D) at one end and a second smaller thickness (D') at the opposite end, so that each washer member is thicker at one end than at its opposite end, said wedge cross-section having a first surface extending perpendicularly to a longitudinal axis (7") of said rivet shaft (7') and a second surface extending at said slanting angle (α) relative to said longitudinal rivet shaft axis (7"), and wherein each washer member has a countersink recess for receiving a respective one of said first and second rivet heads, said countersink recess extending in the direction of said longitudinal rivet shaft axis (7").

30. A device for securing a rotor blade having a blade foot with axial blade foot end faces and with a blade foot sole (5') in a blade mounting groove of a rotor disk having a rotor rim with axial rim side surfaces, said blade mounting groove having a groove bottom in said rotor rim and groove side surfaces inter-meshing with blade foot side surfaces, comprising a gap (S) with open ends in said blade mounting groove (6) between said foot sole (5') and said groove bottom (6'), a rivet (7) with a rivet shaft (7') in said gap (S), said rivet shaft comprising a first rivet head (8) at one end of said shaft, a second rivet head (9) at the other end of said rivet shaft (7'), and a washer member (10, 11, . . . ) between each rivet head and a respective axial rim side surface of said axial rim side surfaces, said washer member being so dimensioned that a rim facing washer surface bears partly against one of said axial rim side surfaces and partly against one of said axial end faces of a respective blade foot when a riveting operation is completed, and wherein said foot sole (5') comprises a longitudinal groove (14) in which said rivet shaft (7') is at least partly received.

31. A device for securing a rotor blade having a blade foot with axial blade foot end faces and with a blade foot sole (5') in a blade mounting groove of a rotor disk having a rotor rim with axial rim side surfaces, said blade mounting groove having a groove bottom in said rotor rim and groove side surfaces inter-meshing with blade foot side surfaces, comprising a gap (S) with open ends in said blade mounting groove (6) between said foot sole (5') and said groove bottom (6'), a rivet (7) with a rivet shaft (7') in said gap (S), said rivet shaft comprising a first rivet head (8) at one end of said shaft, a second rivet head (9) at the other end of said rivet shaft (7'), and a washer member (10, 11, . . . ) between each rivet head and a respective axial rim side surface of said axial rim side surfaces, said washer member being so dimensioned that a rim facing washer surface bears partly against one of said axial rim side surfaces and partly against one of said axial end faces of a respective blade foot when a riveting operation is completed, said device further comprising in said gap (S) means for applying a radially effective force between said blade foot sole (5') and said rotor rim, whereby radial play between said rotor blade and said rotor rim is reduced or eliminated.

* * * * *

UNITED STATES PATENT AND TRADEMARK OFFICE
CERTIFICATE OF CORRECTION

PATENT NO. : 5,727,927

DATED : Mar. 17, 1998

INVENTOR(S) : Luxenburger

It is certified that error appears in the above-identified patent and that said Letters Patent is hereby corrected as shown below:

On the Title Page:

In [56] References Cited
U.S. PATENT DOCUMENTS:
please add: --4,279,572 7/1981 Auriemma--.

Col. 9, line 18, after "Fig. 11" insert --, whereby the radially outwardly effective biasing force P--;
line 19, before "foot" replace "blades" by --blade--; after "reduce" replace "of" by --or--.

Col. 13, line 35, after "of" replace "claim 24," by --claim 4,--;
line 50, after "of" replace "claim 8," by --claim 4,--.

Col. 14, line 64, after "angle" replace "(G)" by --(α)--.

Signed and Sealed this

Sixteenth Day of June, 1998

*Attest:*

Bruce Lehman

BRUCE LEHMAN

*Attesting Officer*

*Commissioner of Patents and Trademarks*